US008593359B2

(12) United States Patent
Wu

(10) Patent No.: US 8,593,359 B2
(45) Date of Patent: Nov. 26, 2013

(54) ANTENNA

(75) Inventor: Chia-Ching Wu, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 311 days.

(21) Appl. No.: 13/031,583

(22) Filed: Feb. 21, 2011

(65) Prior Publication Data

US 2012/0086617 A1 Apr. 12, 2012

(51) Int. Cl.
*H01Q 9/00* (2006.01)
*H01Q 11/12* (2006.01)

(52) U.S. Cl.
USPC ..... 343/749; 343/741; 343/702

(58) Field of Classification Search
USPC ..... 343/749, 731, 828, 850, 899, 752, 780
See application file for complete search history.

(56) References Cited

U.S. PATENT DOCUMENTS

| | | | | |
|---|---|---|---|---|
| 6,452,554 | B1 * | 9/2002 | Aoyama et al. | 343/702 |
| 6,501,425 | B1 * | 12/2002 | Nagumo et al. | 343/700 MS |
| 2007/0040747 | A1 | 2/2007 | Kinezos | |
| 2009/0015510 | A1 * | 1/2009 | Nakata et al. | 343/878 |
| 2009/0284418 | A1 * | 11/2009 | Shih | 343/700 MS |
| 2010/0013732 | A1 * | 1/2010 | Kapuliansky et al. | 343/866 |
| 2010/0026594 | A1 * | 2/2010 | Yang et al. | 343/702 |
| 2010/0259455 | A1 * | 10/2010 | Thornell-Pers | 343/702 |

* cited by examiner

*Primary Examiner* — Jerome Jackson, Jr.
*Assistant Examiner* — Ricardo Magallanes
(74) *Attorney, Agent, or Firm* — Altis Law Group, Inc.

(57) ABSTRACT

An antenna includes a metal member, an antenna, and a capacitor. The metal member includes a plurality of sidewalls connecting with each other. The antenna includes a fixing end and a free end, the fixing end is fixed to the metal member. The capacitor connects with the metal member and the free end of the antenna.

5 Claims, 3 Drawing Sheets

ANTENNA

BACKGROUND

1. Technical Field

The present disclosure relates to antennas, and particularly to an antenna suitable for use with a miniature electronic device.

2. Description of Related Arts

FIG. 1 shows a conventional antenna 1 including a circuit board 2, an aerial 3, and a capacitor 4. For a better performance, the circuit board 2 usually needs to have a large size, and the aerial 3 needs to be set in a middle position of the circuit board 2. This type of antenna is not suitable to be used in a miniature electronic device.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail below, with reference to the accompanying drawings.

Figure 2:
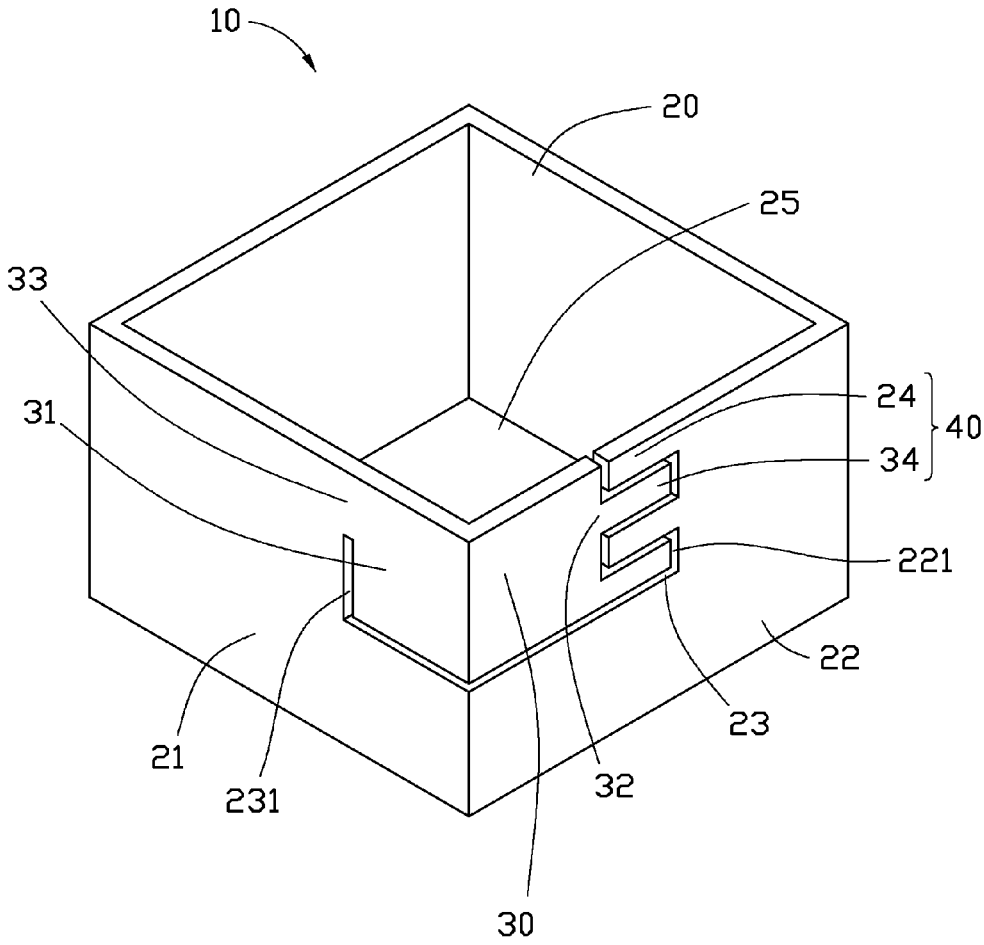
FIG. 2 is a schematic, isometric view of an antenna in accordance with an exemplary embodiment.

Referring to FIG. 2, an antenna 10 includes a metal member 20 and an aerial 30. The metal member 20 is a hollow and includes a number of sidewalls. A first sidewall 21 and a second sidewall 22 are connected with each other. The metal member 20 further includes a bottom 25 connecting with all the sidewalls thereof. Two first coupling tabs 24 protrude from an edge 221 of the sidewall 22. The two first coupling tabs 24 are spaced from each other.

A cut-out 23 is defined in the sidewalls 21 and 22. The aerial 30 is received in the cut-out 23. In the embodiment, the aerial 30 is integrally formed with the metal member 20. In an alternative embodiment, the aerial 30 and the metal member 20 may be separate parts that are connected together.

The aerial 30 includes a feed-in portion 31, a fixed end 33, and a free end 32. The fixed end 33 is fixed to an edge 231 of the cut-out 23 and is grounded. In addition to the fixed end 33, the other portions of the aerial 30 stay out of contact with the metal member 20. Two second coupling tabs 34 protrude from the free end 33, and are spaced apart. The second coupling tabs 34 and the first coupling tabs 24 of the metal member 20 are alternatively arranged and cooperatively form a coupling capacitor 40.

Figure 3:
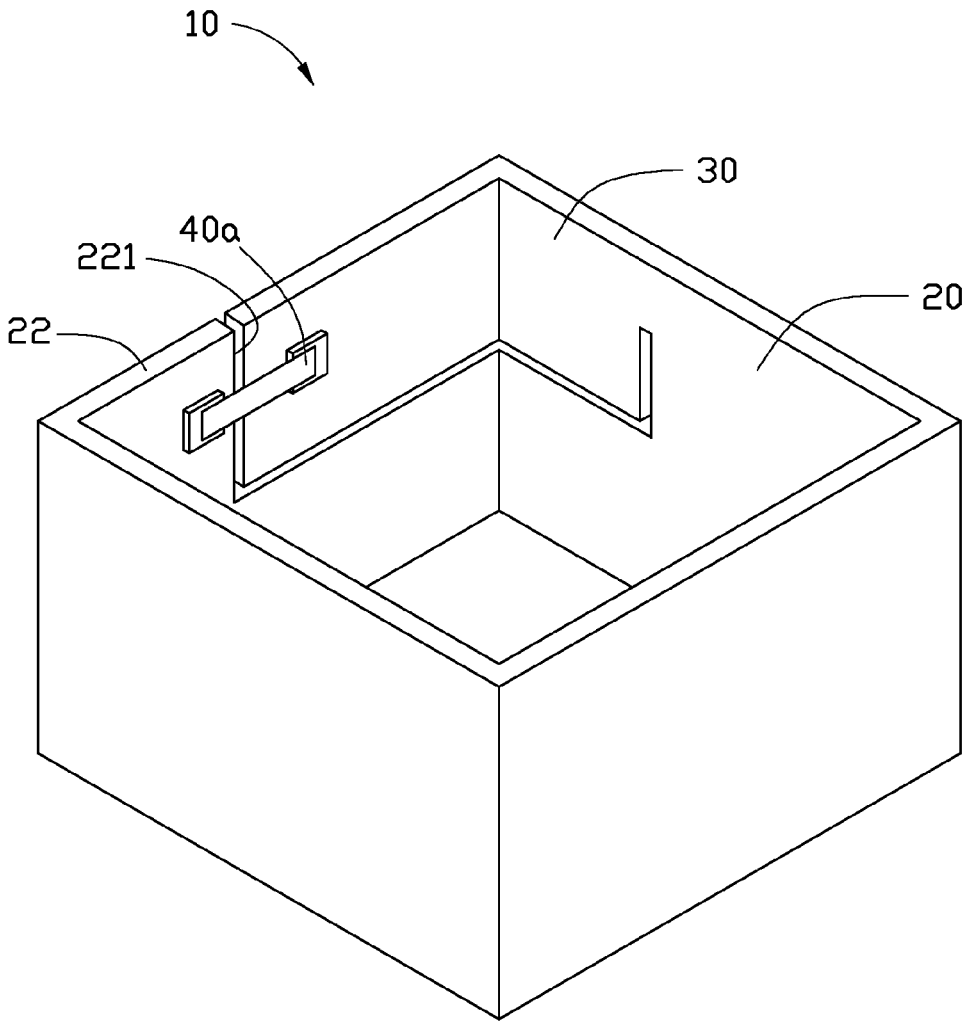
FIG. 3 is a schematic, isometric view of an antenna in accordance with another exemplary embodiment.

Referring to FIG. 3, in an alternative embodiment, a capacitor 40*a*, which replaces the capacitor 40, is connected between the free end 33 of the aerial 30 and the edge 221 of the sidewall 22 of the metal member 20.

Figure 1:
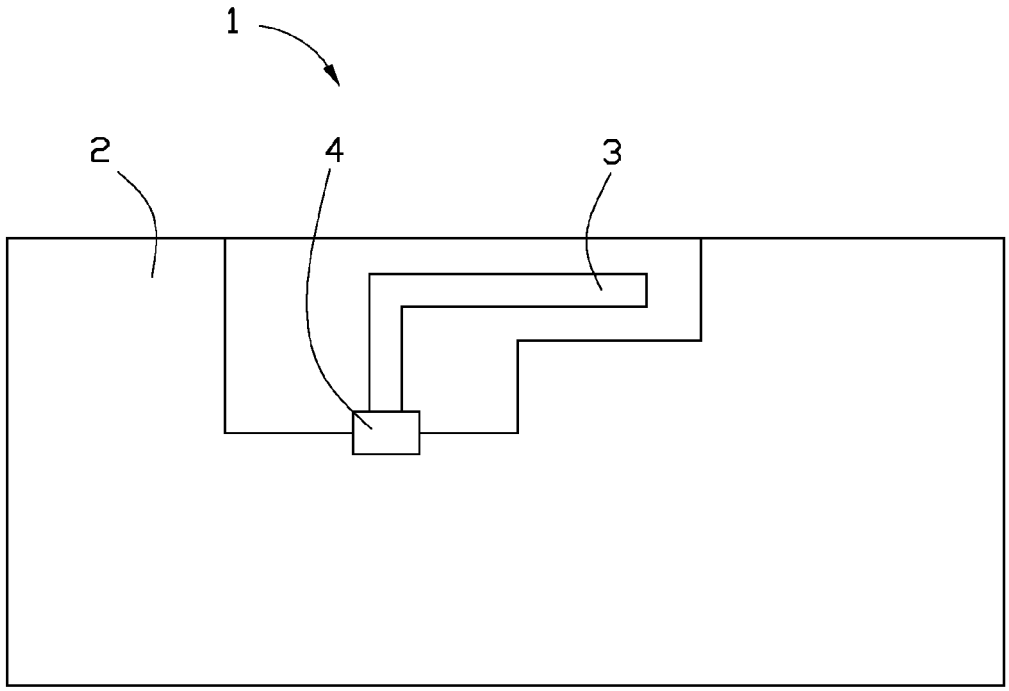
FIG. 1 (RELATED ART)
FIG. 1 is a schematic planar view of a conventional antenna.

When the circuit board 2 of the conventional antenna 1 shown in FIG. 1 and the metal member 20 have the same area, the antennas 10 and 1 have substantially the same performance. However, the space for the antenna 10 is smaller than for the antenna 1. Therefore, the antenna 10 is more suitable for use with a miniature electronic device. Furthermore, the metal member 20 may be used as a portion of a case of the miniature electronic device.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. An antenna comprising:

a metal member comprising a plurality of sidewalls connecting with each other, the metal member defining a cut-out in two connected sidewalls of the plurality of sidewalls;

an aerial received in the cut-out and comprising a fixed end and a free end, the fixed end being fixed to an edge of the cut-out and grounded; and a capacitor connecting with the metal member and the free end of the aerial.

2. The antenna according to claim 1, wherein the aerial is integrally formed with the metal member.

3. The antenna according to claim 1, wherein the aerial and the metal member are separately formed.

4. The antenna according to claim 1, wherein the metal member comprises four sidewalls connected together.

5. The antenna according to claim 1, wherein the free end of the aerial comprises two spaced first coupling members, one of the two connected sidewalls comprises two spaced second coupling members, the first coupling members and the second coupling members are alternatively arranged and cooperatively form the capacitor.

* * * * *